US005383527A

United States Patent [19]

Azar

[11] Patent Number: 5,383,527

[45] Date of Patent: Jan. 24, 1995

[54] ASYMMETRICAL PDC CUTTER

[75] Inventor: Michael G. Azar, Houston, Tex.

[73] Assignee: Smith International, Inc., Houston, Tex.

[21] Appl. No.: 121,808

[22] Filed: Sep. 15, 1993

[51] Int. Cl.[6] ..... E21B 10/46

[52] U.S. Cl. ..... 175/431; 175/432

[58] Field of Search ..... 175/430, 431, 432, 434, 175/435

[56] References Cited

U.S. PATENT DOCUMENTS

| | | | |
|---|---|---|---|
| 4,200,159 | 4/1980 | Peschel et al. | 175/432 X |
| 4,679,639 | 7/1987 | Barr et al. | 175/432 |
| 4,877,096 | 10/1989 | Tibbitts | 175/432 |
| 4,942,933 | 7/1990 | Barr et al. | 175/431 |
| 4,993,505 | 2/1991 | Packer et al. | 175/431 |
| 5,007,493 | 4/1991 | Coolidge et al. | 175/432 |
| 5,028,177 | 7/1991 | Meskin et al. | 175/430 |
| 5,115,873 | 5/1992 | Pastusek | 175/430 X |

*Primary Examiner*—Ramon S. Britts
*Assistant Examiner*—Frank S. Tsay
*Attorney, Agent, or Firm*—Robert G. Upton

[57] ABSTRACT

A polycrystalline diamond compact (PDC) drag bit cutter is disclosed that provides more clearance between the cutter's drilling edge and the drag bit body mounting blade. This allows for more efficient hydraulic cooling and cleaning of the cutters, thereby achieving faster drilling rates. A cylindrical carbide cutter base end having an off-set asymmetric diamond cutting end provides for less interference of the bit head surfaces and the rock formation being drilled, thereby reducing detrimental heat and also allowing a greater depth of penetration of the cutter.

16 Claims, 3 Drawing Sheets 46
47
30
45
30
51
32
51
30
40
48
32

ASYMMETRICAL PDC CUTTER

BACKGROUND OF THE INVENTION

I. FIELD OF THE INVENTION

This invention relates to diamond drag bits.

More particularly, this invention relates to diamond cutting elements for diamond drag bits.

II. DESCRIPTION OF THE PRIOR ART

Polycrystalline diamond compacts (PDC) are used extensively for cutters on drag bits for drilling soft to medium earthen formations in petroleum and mining exploration.

One of the most common type PDC cutters used in diamond drag bits for drilling predominately ductile medium strength formations is a cylinder type. A cylinder type PDC comprises a right cylinder tungsten carbide body with a thin layer (approximately 0.030" to 0.040") of polycrystalline diamond chemically and metallurgically bonded to an end face of the cylinder using a high pressure/high temperature (HP/HT) sintering process.

Although cylindrical PDC type cutters serve a very useful purpose in drilling, there are disadvantages in their application. Typically, a cylinder type PDC cutter is fixedly mounted, by brazing, in a socket formed on the outer surface of a blade fabricated on the drilling face of a drag bit. The diamond face of the cutter is oriented substantially parallel to a radius of the borehole being drilled. The PDC cutter is positioned with back rake and heel clearance for the diamond cutting face by tilting the trailing end of the cutter body upward in relation to the borehole bottom.

For drilling many ductile rock formations, presently used PDC cylinder cutters do not have the necessary clearance from the diamond cutting edge to the supporting blade outer surface paralleling the formation bottom. Therefore, the displaced rock formation interferes with the aforementioned blade outer surface and greatly retards the drilling rate.

Also, because of the limited stand-off of the current diamond cutters from the blade surface, sufficient cooling and cleaning of the cutter often is not accomplished. This is because the entire exposed portion of the cutter is indented into the ductile rock leaving no room for the drilling fluid to flush across the cutter face.

Because of the relatively small exposure of the diamond cutting face of the prior art cutters, the drilling life of the bit is limited to the amount of wear the cutter can experience before the rock formation continuously bears on the insert supporting blade outer surface stopping the drilling process. This wear amount is normally somewhat less than one-half the cutter diameter.

Normally, prior art cylindrical PDC cutters only have approximately one half of the cutter body surface area brazed into the socket on the blade surface. In cases where the rock formations are tough in shear and high impact loads are experienced, the braze strength is often insufficient to keep the cutters in place, thereby contributing to the termination of the bit run.

As a normal PDC cylinder type cutter wears during drilling, an ever enlarging wear flat forms on the bottom side of the carbide cylinder body on the trailing side of the diamond layer, thus slowing the drilling rate. The possible magnitude of the wear flat is determined by the original amount of heel clearance between the diamond cutting point and the blade outer surface.

A new PDC cutter for a drag type drilling bit is disclosed which overcomes the inadequacies of the prior art. The new asymmetric cutter provides more extension of the diamond cutting edge below the face of the drill bit. This permits better cleaning and cooling of the cutters and prevents the rock being drilled from bearing on the bit body surface, thereby significantly increasing the drilling rate and useful bit life.

SUMMARY OF THE INVENTION

It is an object of the present invention to drill soft to medium ductile earthen formations at a faster rate and have a longer drilling life than is currently achieved with present day drag bits.

More specifically, it is an object of the present invention to provide an asymmetric PDC cutter that can be mounted on drag bits of standard design to drill faster and last longer than bits fitted with state of the art cylinder type PDC cutters.

A new asymmetric PDC cutter for drag type bits for drilling soft to medium ductile rock formations is disclosed.

The disclosed cutter is designed to provide greater stand-off between the cutter's drilling edge and the bit body blade in which it is mounted, than is possible with prior art PDC cutters.

The disclosed asymmetric cutter is designed and oriented so that it can wear significantly more than a prior art cutter but still have a smaller wear flat.

The new cutter is designed to be brazed into a full-round socket formed in a bit blade rather than a half round socket as is typically used for prior art cylinder type cutters.

A significant amount of heel relief of the carbide cutter body behind the asymmetric diamond cutter face is designed into the cutter profile to minimize the amount of interference between the cutter body and the rock being drilled.

A drag rock bit for drilling earthen formations is disclosed. A rock bit body forms a first threaded pin end and a second cutting end. The cutting end forms at least a pair of substantially radially disposed raised cutter blades and fluid channels formed therebetween, each fluid channel communicates with a fluid plenum formed by the bit body via at least one fluid exit port formed by the second cutting end of the bit body.

A multiplicity of asymmetric cutter inserts are retained in each of the raised cutter blades. Each insert consists of an insert body forming a first cylindrical insert base end and a second non-cylindrical insert cutter end. The non-cylindrical insert cutter end forms an ultra-hard cutting surface thereon. A plane of the cutting surface is about 90 degrees to an axis of the cylindrical insert base end. A portion of the non-cylindrical insert cutter end projects beyond the circumferential wall formed by the cylindrical insert base end toward the earthen formation to be cut. The cylindrical base end of each of the inserts is adapted to be completely encapsulated within a complimentary cylindrical socket formed in the raised cutter blade. The insert cutter end further projects beyond a surface of the raised cutter blades toward the earthen formation.

An advantage then of the present invention over prior art cutters is the designed asymmetric stand-off of the cutter's drilling edge and bit blade surface results in better cleaning and cooling of the cutter for increased drilling rates and bit drilling life. This asymmetric stand-off also prevents the blade's outer surface from riding on the rock formation, thus allowing greater depth of penetration of the cutter into the rock for higher drilling rates.

Another advantage of the present invention over prior art cylindrical cutters is the smaller wear flat surface formed on the carbide cutter body as the diamond cutting surface wears. This allows the cutter to penetrate the rock using lower drilling loads and still achieve better drilling rates.

Still another advantage of the present invention over prior art cutters is by using a full-round mounting socket rather than a half-round socket, as used with the prior art cutters, a vastly superior braze and retention of the cylindrical base portion of the asymmetric diamond cutter to the bit blade is achieved.

Still yet another advantage of the present invention over prior art cutters is the generous relief formed behind the asymmetric diamond cutter face. This relief provides for less cutter body contact with the rock formation on the borehole bottom than is possible when using prior art straight cylinder cutters with the same amount of cutter wear. Thus, high drilling rates are achieved when using the same drilling weights as used with prior art cutters.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
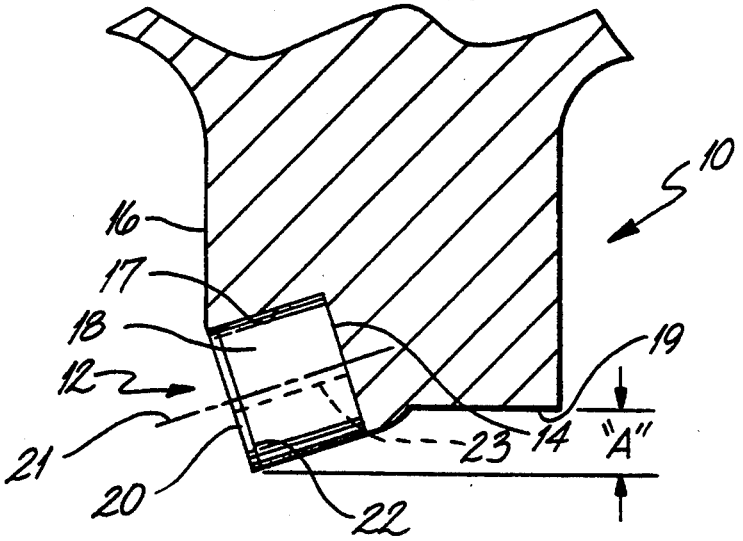
Fig. 1 PRIOR ART
FIG.1 is a partial cross-sectional view of a blade formed on a drag bit having a prior art cylindrical type PDC cutter secured in place in the leading edge of the blade.

With reference to the partial cross-sectional view of FIG. 1, a blade, generally described as 10 is illustrated. The blade from a prior art drag bit (not shown) is extended downward from a bit body toward a borehole bottom (not shown). Blade 10 may be formed from steel or tungsten carbide matrix depending upon the specific field application. A cylindrical polycrystalline diamond compact (PDC) cutter 12 is shown brazed in a socket 14 which is formed into the leading edge 16 of blade 10. A thin (0.030"–0.040") layer of polycrystalline diamond 20 is shown sintered to an end face 22 of the cylindrical carbide body 18. The cutter socket 14 is formed tilted upward at the trailing end 15°–20° in relation to the borehole bottom (not shown). This angled attitude of cutter 12 provides negative back rake to the diamond cutter face 20 to give heel clearance "A" between the rock being drilled surface 19. When using normal drilling weights, the PDC cutter 12 is often buried in the rock formation to a depth "A" where the blade bottom 19 rides on the rock formation as the bit is rotated thereby creating damaging heat. This also prevents drilling fluid from cleaning and cooling the cutter 10 thereby slowing the drilling rate and heat damaging cutter 10.

The cutter socket 14 envelops the cutter body 18 downward a small increment past the cutter centerline 21 as indicated by dashed line 23. This forms an interlock of the blade material that serves to hold the cutter 12 in place while it is being brazed into the blade socket 14. The braze is limited to an area that is only slightly more than one-half of the cylindrical surface 17 of the cutter body 18. This limited braze very often fails from impact and tensile stresses encountered in the drilling process.

Figure 2:
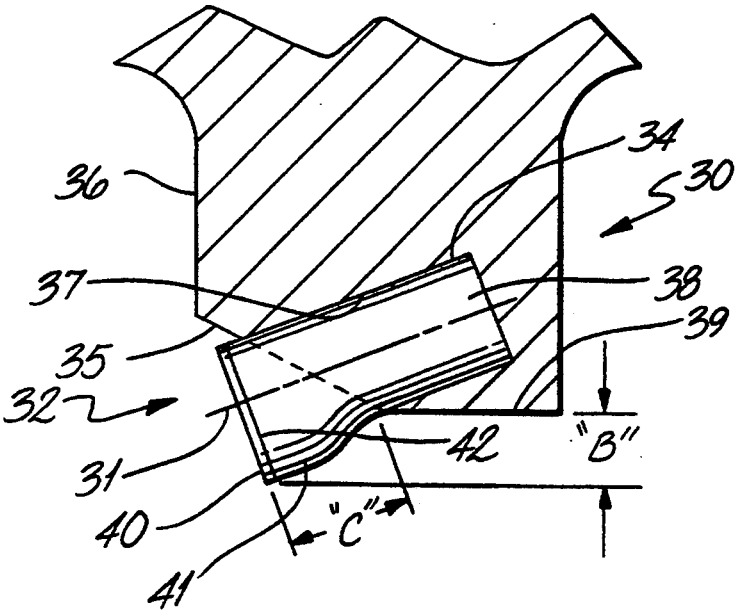
FIG. 2 is a partial cross-sectional view of a blade formed on a drag bit illustrating a preferred embodiment of an asymmetric PDC cutter mounted in the leading edge of the blade.

FIG. 2 is a partial cross-sectional view of drag bit blade 50 with the preferred embodiment of the asymmetric PDC cutter 52 mounted thereon. The blade 50 extends downward from the bit drilling head (48 on FIG. 3) to the borehole bottom (not shown). An asymmetric PDC cutter 32 is attached by brazing into a cylindrical socket 37 formed in blade 30. The socket 34 is formed into the lower leading surface 35 of blade 30 at an angle of 15°–35° in reference to the blade bottom surface 39, with the preferred angle being 20°.

The asymmetric PDC cutter 32 has a cylindrical body or base 38 that is brazed into the cutter socket 34. The drilling end 41 of cutter body 32 has an asymmetrical geometry with the body 38 being cylindrical forming a circumferential wall 45 then blending into an offset half cylindrical surface 41, which is positioned downward in the blade 30 and forms the principal drilling end of the cutter 32. A thin (0.015"to 0.040") polycrystalline diamond layer 40 may be formed on the end surface 42 of the carbide body 38. The off-set or asymmetrical cutting end 41 provides the stand-off "B" between the bottom surface 39 of blade 30 and the rock formation being drilled (not shown). This stand-off "B" is significantly greater than stand-off "A" as described in FIG. 1. This provides more clearance for drilling fluid to clean and cool the cutters 32 and minimize the riding on the formation of lower blade surface 30, thereby increasing the drilling rate. The shorter length "C" of the exposed cutter surface 41 reduces the amount of cutter 32 bearing on the rock as the cutter 32 wears while drilling, thereby drilling faster when using comparable drilling weights and rotational speeds as used with prior art bits.

As the drilling cutter socket 34 is a fully round cylindrical surface, the braze of the cutter body 32 in the socket 34 is very much superior to the prior art cutter braze which is only approximately 55–60% of that of the present invention.

Figure 3:
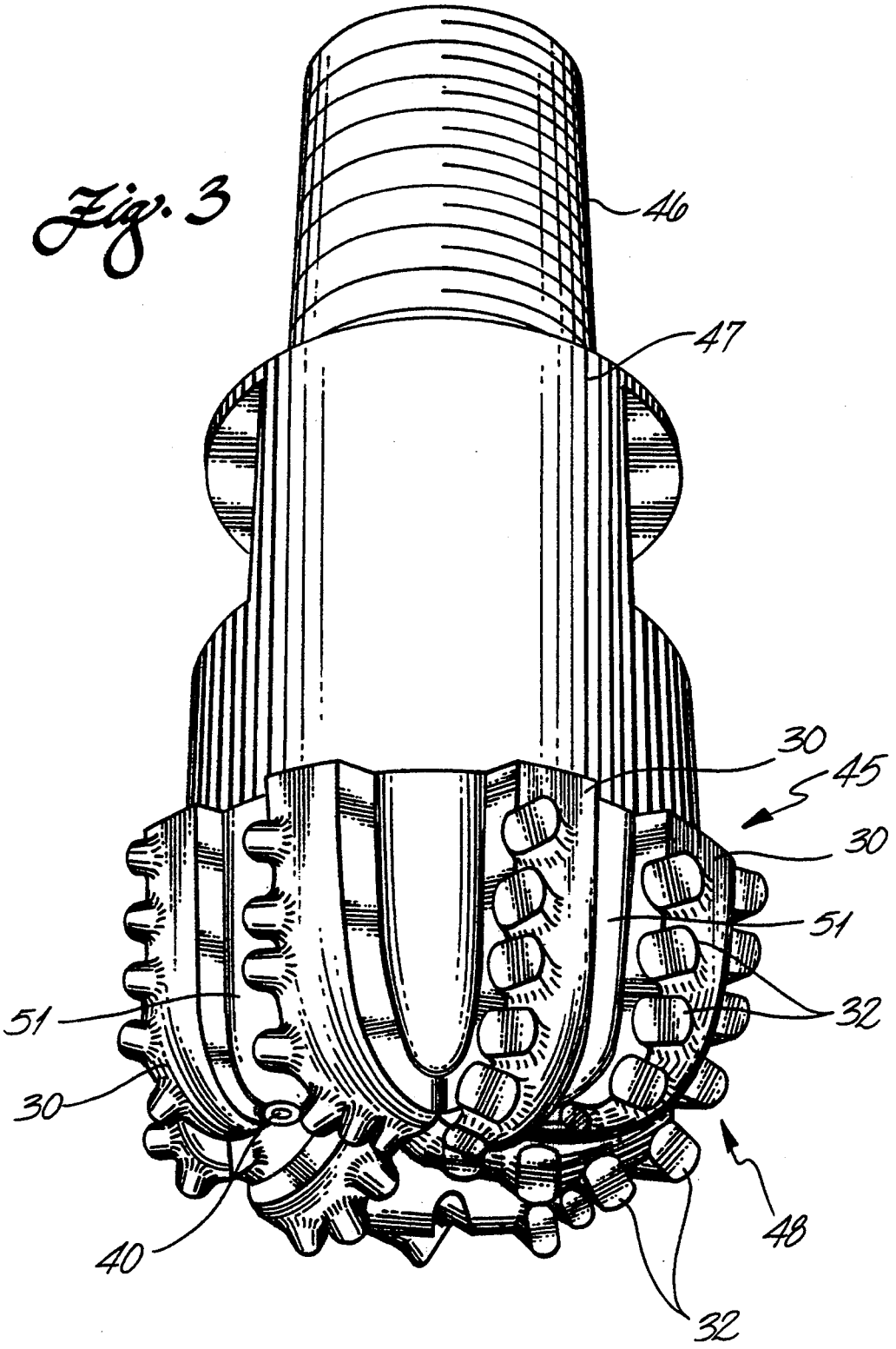
FIG. 3 is a perspective view of a preferred embodiment of the present invention illustrating a drag bit fitted with a new type asymmetric PDC cutter as illustrated by FIG. 2.

FIG. 3, a drag bit, generally designated as 45, consists of a bit body 47 having an open threaded pin end 46 and opposite cutting end generally designated as 48. Cutting end 48 is comprised of a multiplicity of essentially radial raised lands or blades 30 and fluid channels 51 formed between. A number of fluid nozzles 40 are strategically positioned on the cutting end 48 to supply high velocity drilling fluid to fluid channels 51 to cool and clean the cutting end 48. A plurality of polycrystalline diamond compact (PDC) cutters 32 of the present invention are disposed strategically in the outer surfaces of the raised blades 30. As the bit 45 rotates on the bottom of a borehole (not shown), the diamond cutters 32 engage the rock formations with a shearing action to destroy the rock. The drilled rock cuttings are then entrained in the high velocity drilling fluid to exit up the borehole (not shown).

Figure 4:
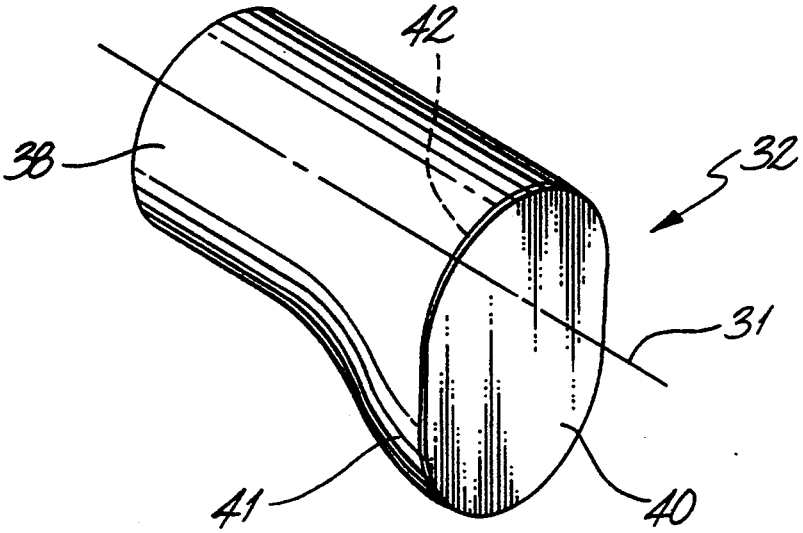
FIG. 4 is a perspective view of a preferred embodiment of a PDC cutter showing the diamond cutting end and the cylindrical mounting end of the cutter.

FIG. 4 is an isometric view of the preferred PDC cutter 32, as shown in FIGS. 2 and 3. Depicted is the asymmetrical off-set, essentially elliptical shaped diamond drilling layer 40, which is sintered to the drilling end face of the tungsten carbide substrate portion 41. This off-set portion 41 blends into the cylindrical carbide base end 38, which is brazed into the cylindrical socket (34 of FIG. 2) completely encapsulating the cylindrical section 38 therein.

The asymmetrical portion 41 of cutter 32 is off-set 30% to 70% greater than the cylindrical diameter of base end 38 with 50% greater being the preferred off-set.

Figure 5:
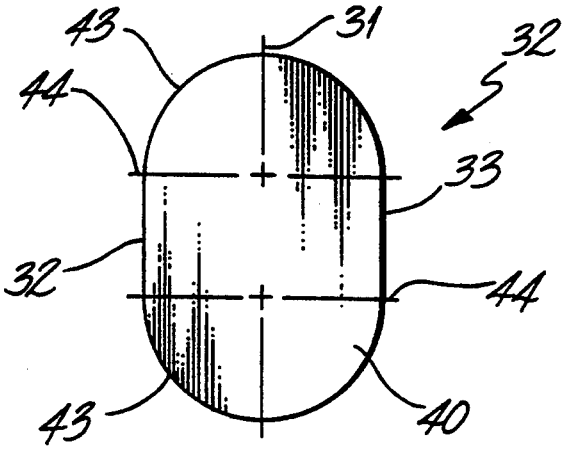
FIG. 5 is a face view of the diamond cutting end of the preferred embodiment of the PDC cutter.

FIG. 5 is a face view of the PDC cutter 32. It shows the diamond face layer 40, which is, for example, essentially elliptical in shape. This diamond drilling face 40 is comprised geometrically of two semi-circular end surfaces having a common vertical axis 31. These semi-circular surfaces are joined by a rectangular surface whose sides 33 are tangent to the semi-circular arcs 43 at centerlines 44.

It is well to note that the diamond layer 40 as described in FIG. 5, as having two arcs with the same radii, can beneficially have arcs 43 with differing radii depending upon the need for a sharper or blunter cutting tip.

It also should be noted that the diamond layer 40 may be a curved surface or any other geometry, but the preferred embodiment is a planar diamond layer 40.

Although the diamond layer 40 has heretofore been referred to as just a polycrystalline diamond layer, those skilled in the art realize that this diamond layer 40 may be comprised of two or more transition layers of diamond powders and sintered carbide powders as needed for particular applications. It would be obvious to utilize cubic boron nitride as well for the cutting surface 40.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. An asymmetric cutter insert comprising;

an insert body forming a first cylindrical base end and a second non-cylindrical cutter end, said non-cylindrical cutter end defining an ultra-hard cutting surface thereon a plane of which is about 90 degrees to an axis of said cylindrical base end, a portion of said non-cylindrical cutter end of said insert projects beyond the circumferential wall formed by the cylindrical base end of said insert toward a surface to be cut.

2. The invention as set forth in claim 1 wherein the ultra-hard cutting surface is polycrystalline diamond.

3. The invention as set forth in claim 1 wherein the ultra-hard cutting surface is transition layers of various hardnesses of diamond crystals and pre-sintered tungsten carbide.

4. The invention as set forth in claim 1 wherein the ultra-hard cutting surface is cubic boron nitride.

5. The invention as set forth in claim 1 wherein said non-cylindrical second cutter end defining said ultra-hard cutting surface comprises a pair of separated portions of a circle joined by linear connecting edges, each end of said linear edge is tangent to each of said circle portions.

6. The invention as set forth in claim 1 wherein said non-cylindrical second cutter end defining said ultra-hard cutting surface comprises a pair of separated half circles joined by substantially parallel linear edges, each end of said parallel linear edge is tangent to each of said separated half circles.

7. The invention as set forth in claim 1 wherein said non-cylindrical cutter end project beyond the circumferential wall formed by said cylindrical base end from 30% to 70% greater than the diameter of said cylindrical base end.

8. The invention as set forth in claim 7 wherein said cutter end projects about 50% greater than the diameter of said cylindrical base end.

9. A drag rock bit for drilling earthen formations comprising;

a rock bit body forming a first threaded pin end and a second cutting end, said cutting end forming at least a pair of substantially radially disposed raised cutter blades and fluid channels formed therebetween, each fluid channel communicates with a fluid plenum formed by said bit body via at least one fluid exit port formed by said second cutting end of said bit body, and a multiplicity of asymmetric cutter inserts consisting of an insert body forming a first cylindrical insert base and a second non-cylindrical insert cutter end, said non-cylindrical insert cutter end forming an ultra-hard cutting surface thereon a plane of which is about 90 degrees to an axis of said cylindrical insert base end, a portion of said non-cylindrical insert cutter end projects beyond the circumferential wall formed by said cylindrical insert base end toward the earthen formation to be cut, said cylindrical base end of each of said inserts being adapted to be completely encapsulated within a complimentary cylindrical socket formed in said raised cutter blade, said insert cutter end further projects beyond a surface of said raised cutter blades toward said earthen formation.

10. The invention as set forth in claim 9 wherein the ultra-hard cutting surface is polycrystalline diamond.

11. The invention as set forth in claim 9 wherein the ultra-hard cutting surface is transition layers of various hardnesses of diamond crystals and pre-sintered tungsten carbide.

12. The invention as set forth in claim 9 wherein the ultra-hard cutting surface is cubic boron nitride.

13. The invention as set forth in claim 9 wherein said non-cylindrical second insert cutter end defining said ultra-hard cutting surface comprises a pair of separated portions of a circle joined by linear connecting edges, each end of said linear edge is tangent to each of said circle portions.

14. The invention as set forth in claim 9 wherein said non-cylindrical second insert cutter end defining said ultra-hard cutting surface comprises a pair of separated half circles joined by substantially parallel linear edges, each end of said parallel linear edge is tangent to each of said separated half circles.

15. The invention as set forth in claim 9 wherein said non-cylindrical cutter end projects beyond the circumferential wall formed by said cylindrical base end from 30% to 70% greater than the diameter of said cylindrical base end.

16. The invention as set forth in claim 15 wherein said cutter end projects about 50% greater than the diameter of said cylindrical base end.

* * * * *